US010692683B2

(12) United States Patent
Costello et al.

(10) Patent No.: US 10,692,683 B2
(45) Date of Patent: Jun. 23, 2020

(54) THERMALLY ASSISTED NEGATIVE ELECTRON AFFINITY PHOTOCATHODE

(71) Applicant: Intevac, Inc., Santa Clara, CA (US)

(72) Inventors: Kenneth A. Costello, Union City, CA (US); Verle W. Aebi, Menlo Park, CA (US); Michael Jurkovic, San Ramon, CA (US); Xi Zeng, San Jose, CA (US)

(73) Assignee: INTEVAC, INC., Santa Clara, CA (US)

( * ) Notice: Subject to any disclaimer, the term of this patent is extended or adjusted under 35 U.S.C. 154(b) by 0 days.

(21) Appl. No.: 15/702,647

(22) Filed: Sep. 12, 2017

(65) Prior Publication Data

US 2019/0080875 A1 Mar. 14, 2019

(51) Int. Cl.

| | |
|---|---|
| ***H01J 29/04*** | (2006.01) |
| ***H01J 31/48*** | (2006.01) |
| ***H01J 31/49*** | (2006.01) |

(52) U.S. Cl.

CPC ..... *H01J 29/04* (2013.01); *H01J 31/48* (2013.01); *H01J 31/49* (2013.01); *H01J 2231/501* (2013.01)

(58) Field of Classification Search

CPC .. H01J 29/04; H01J 31/48; H01J 31/49; H01J 2231/501

See application file for complete search history.

(56) References Cited

U.S. PATENT DOCUMENTS

| | | | | |
|---|---|---|---|---|
| 4,829,355 | A * | 5/1989 | Munier | H01J 1/34 257/11 |
| 5,268,612 | A * | 12/1993 | Aebi | H01J 43/246 313/103 CM |
| 5,349,177 | A * | 9/1994 | Thomas | H01J 31/50 250/214 VT |
| 5,712,490 | A * | 1/1998 | Smith | H01J 1/34 257/10 |
| 6,350,999 | B1 * | 2/2002 | Uenoyama | H01J 1/308 257/101 |
| 6,483,231 | B1 * | 11/2002 | Iosue | H01J 31/49 250/207 |
| 2004/0084667 | A1 * | 5/2004 | Takahashi | B82Y 20/00 257/11 |
| 2004/0104404 | A1 * | 6/2004 | Bito | H01L 29/0843 257/192 |
| 2005/0106983 | A1 * | 5/2005 | Iosue | H01J 31/507 445/23 |
| 2007/0158638 | A1 * | 7/2007 | Perera | B82Y 20/00 257/13 |

OTHER PUBLICATIONS

International Preliminary Report on Patentability for PCT/US2018/050735, filed Sep. 12, 2018, dated Mar. 17, 2020, 12 pages.

* cited by examiner

*Primary Examiner* — Peniel M Gumedzoe
(74) *Attorney, Agent, or Firm* — Womble Bond Dickinson (US) LLP; Joseph Bach, Esq.

(57) ABSTRACT

A novel photocathode employing a conduction band barrier is described. Incorporation of a barrier optimizes a trade-off between photoelectron transport efficiency and photoelectron escape probability. The barrier energy is designed to achieve a net increase in photocathode sensitivity over a specific operational temperature range.

19 Claims, 6 Drawing Sheets

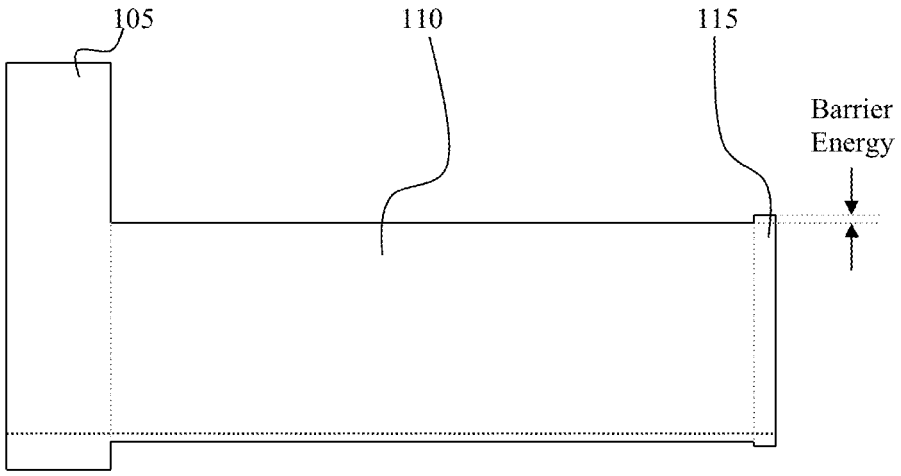
Figure 1A
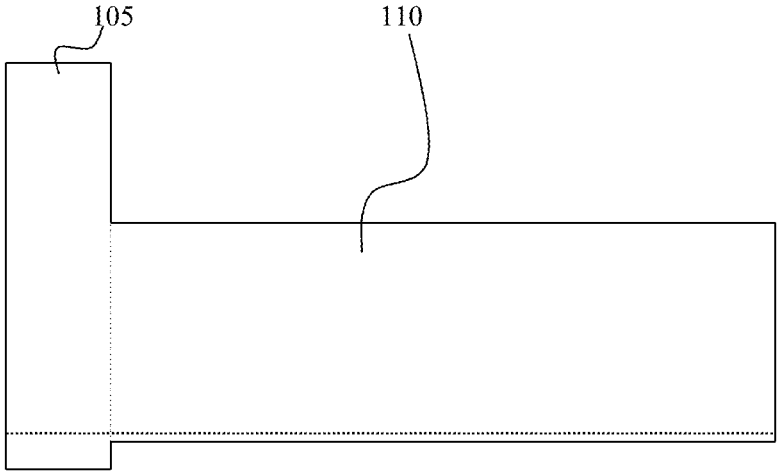
Figure 1B*: Prior Art*

THERMALLY ASSISTED NEGATIVE ELECTRON AFFINITY PHOTOCATHODE

BACKGROUND

1. Field

This invention falls in the field of effectively negative electron affinity semiconductor photocathodes. This invention describes a new photocathode structure incorporating a single small conduction band barrier between an optical absorber layer and an effectively negative electron affinity photocathode emission surface. This thermally assisted negative electron affinity (TANEA) photocathode is appropriate for use in photomultiplier tubes and night vision sensors. This invention will have the greatest benefit for photocathodes in the visible and near infrared portion of the spectrum, designed to operate above cryogenic temperatures.

2. Related Art

Photocathodes come in a wide variety of types and subclasses. Many of the early night image intensifiers employed Multialkali Antimonide Photocathodes as described by Sommer in Photoemissive Materials, A. H. Sommer, Robert E. Krieger Publishing Company, Huntington, N.Y., 1980. Modern versions of these photocathodes account for a significant fraction of the image intensifiers sold and in use today. In the 1950s, research on a new class of photocathodes was anchored and accelerated when William E. Spicer reported a detailed photocathode model in Phys. Rev. 112, 114 (1958) to give understanding of photocathode device physics and permit engineering of photocathodes for specific performance characteristics. The instant disclosure makes use of an effective negative electron affinity (NEA) photocathode structure. Professor William Spicer described a three step model detailing optical absorption, photoelectron transport and photoemission. Application of this model to the proposed, new and inventive photocathode structure, provides a foundation upon which the current invention may be described and understood.

After Spicer's publication, numerous varieties of photocathodes were developed. U.S. Pat. No. 3,631,303 details one of the early NEA photocathode designs that employs a band-gap graded semiconductor optical absorber layer. In the described structure, the semiconductor substrate is a large band-gap material that acts as a passivation layer for the back surface of the active layer. Though described as a reflection mode photocathode, by using a thin substrate window layer, the structure works equally well in a transmission mode. A modern third generation image intensifier photocathode as disclosed in U.S. Pat. No. 5,268,570 makes use of a p-type GaAs or InGaAs optical absorber layer coupled with a p-type AlGaAs window layer. High p-type doping levels typically $>1\times10^{18}/cm^3$ and the larger band-gap of the AlGaAs or AlInGaAs window layer result in a hetero-structure that is very efficient at preserving photogenerated electrons. An example and method of manufacture of a modern GaAs photocathode is described in U.S. Pat. No. 5,597,112. Photoelectrons that diffuse to the heterojunction experience a potential barrier and are reflected back into the absorber layer and hence, toward the vacuum emission surface. The ramped band-gap structure described in 3,631,303 plays a similar role in directing the diffusion/drift of photoelectrons toward the vacuum emission surface.

U.S. Pat. No. 5,712,490 describes a photocathode incorporating a combined compositional ramp and a predetermined doping profile near the emission surface of the photocathode "for maintaining the conduction band of the device flat until the emission surface" in order to increase photoresponse. Additionally, purpose-specific photocathodes incorporating sophisticated quantum well structures have been designed for use in electron accelerators; U.S. Pat. No. 8,143,615 describes such a structure. The superlattice structure cited in U.S. Pat. No. 8,143,615 incorporates a series of barriers and wells designed to produce a mini-band allowing high brightness monochromatized electron emission. Fundamental to the design of the photocathode, photogenerated electrons transit the barriers between the individual quantum wells via tunneling thereby creating the mini-bands. Significant thermal excitation of electrons over the conduction band barrier would violate the claimed functionality of the invention to generate an electron beam having a monochromatized energy state.

The semiconductor NEA photocathodes sited in the previous paragraphs can be classed as passive photocathodes. In use, these cathodes are set to a single fixed electrical potential. In other words, there are no electric fields within the cathode that are specified through the application of an electrical bias voltage across two or more contact terminals.

Although other classes of biased photocathodes exist, the additional complication, cost and often the increased dark current associated with biased photocathode structures, make them inappropriate for a range of applications. Current GaAs-based night vision cathodes are capable of achieving room temperature emitted dark currents on the order of $1\times10^{-14}$ A/cm$^2$ while simultaneously demonstrating external quantum efficiencies in excess of 40%. Meeting GaAs demonstrated performance levels is a very demanding requirement for biased photocathode structures.

SUMMARY

Embodiments of the current invention fall into the class of passive photocathodes.

A p-type semiconductor photocathode according to a first aspect of the present invention includes a barrier or rise in the conduction band energy as referenced to the Fermi level falling between an optical absorber layer and the vacuum emission surface of the photocathode. Whereas the incorporation of a barrier in the conduction band may appear to be counterintuitive, it allows a trade-off to be made between photoelectron transport efficiency to the emission surface and photoelectron escape probability. Generally, photoelectron transport efficiency to the emission surface decreases as the conduction band barrier height is increased. Alternately, NEA photocathode escape probability generally increases with increasing energy spread between the conduction band at the surface and the Fermi level. Consequently, photogenerated electron escape probability generally increases as the barrier height increases for those electrons that successfully transit over the barrier. This disclosure teaches that the rate of increase in escape probability can exceed the loss of photoelectron transport efficiency as the barrier height is increased for a range of photocathodes, including the economically important GaAs photocathode, when operated near room temperature or at temperatures greater than −40 degrees C. as is relevant for use of night vision devices in Arctic environments.

The barrier thickness is set to be sufficient to ensure that transmission of photoelectrons across the barrier is dominated by thermally excited electrons with sufficient energy to exceed the barrier height at the designated operating temperature as opposed to tunneling through the barrier. Additionally, the combined thickness and doping level of the barrier is sufficient to ensure that any depletion layer that may form beneath the semiconductor surface does not penetrate the barrier layer to the point where the barrier layer is fully depleted or reduce the effective barrier thickness to the point where tunneling through the energy barrier predominates. A barrier meeting the previously stated requirements may be referred to as a thermionic emission barrier. Thermalized photoelectrons in the conduction band (at temperatures >0K) have a finite chance of transiting the barrier layer of the photocathode due to thermionic excitation over the conduction band barrier. Photoelectrons which transit over the conduction band barrier benefit from an increase in escape probability from a proximate negative electron affinity vacuum interface when compared to a photocathode structure lacking the barrier. This demonstrated improved level of performance may be qualitatively explained via two key observations:

1. The average energy of electrons presented to the vacuum emission surface is increased when a thermionic emission barrier (115) is present vis-à-vis the prior art photocathode depicted in FIG. 1B. The increased energy allows increased energy loss to occur after the electrons enter the depleted region adjacent to the interface between the activation layer (135) and the semiconductor photocathode surface before the photoelectron falls below the proximate energy of a free electron in vacuum. Essentially, the thermionic emission barrier (115) performs a photoelectron energy filtering function, selectively transmitting the photoelectrons that fall at the high end of the thermalized distribution for an attempt at photoemission. The higher average energy of these photoelectrons relative to the photoelectron energy distribution of the photoelectrons in the absorber layer (110) directly increases the escape probability of the photoelectrons presented to the surface for emission. Consequently, the escape probability of the electrons exiting a TANEA photocathode is higher than that of a prior art photocathode.

2. Decoupling the optical absorber layer (110) material parameters from the requirements required for photoemission allows a lower doping level to be used in the optical absorber layer than is practicable in the prior art photocathode shown in FIG. 1B. Decreased doping levels can increase minority carrier lifetime in high quality direct bandgap photocathodes. With sufficient carrier lifetime, the photoelectrons that fail to transit the thermionic emission barrier (115) on any given attempt have a high probability of diffusing back to the barrier-optical absorber layer interface (110 to 115 interface) for an additional attempt. For each trial at transmission over the barrier the photoelectron energy will vary. Statistically, the photoelectron energy, relative to the Fermi level, will span the conduction band minimum plus a thermal energy distribution determined by both the conduction band density of states and the temperature. This distribution may be described as a function of kT where k is the Boltzmann Constant and T is the semiconductor lattice temperature in degrees Kelvin. Consequently, an electron that may have fallen low in the statistical energy distribution when it first encountered the thermionic emission barrier may fall at the high end of the statistical energy distribution of thermalized photoelectrons within the absorber layer on a subsequent trial. As long as the net loss of photoelectrons due to carrier lifetime limits is less that the net increase in escape probability detailed under observation 1, the TANEA photocathode will exhibit improved performance vis-a-via prior art photocathodes.

The combined effect of the reduced photoelectron transport efficiency associated with transiting the barrier and the increase in escape probability associated with the increase of the photoelectron energy with respect to the Fermi energy of the structure results in increased overall photocathode sensitivity for a small range of barrier energies.

Embodiments of the thermally assisted photocathode as detailed below are presented as practical examples in order to aid in explanation of the invention, not to limit the scope of the present invention. Those skilled in the art are anticipated to use elements and teachings of this disclosure to craft equivalent distinct photocathode embodiments optimized for their specific temperature range, semiconductor material and detection wavelength requirements; these variants remain within the scope of this disclosure.

Other features and aspects are described in the following Detailed Description with reference to the Drawings.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 1A is a schematic bandgap diagram of an exemplary thermally assisted photocathode. FIG. 1B shows a prior art photocathode.

DETAILED DESCRIPTION

Figure 2:
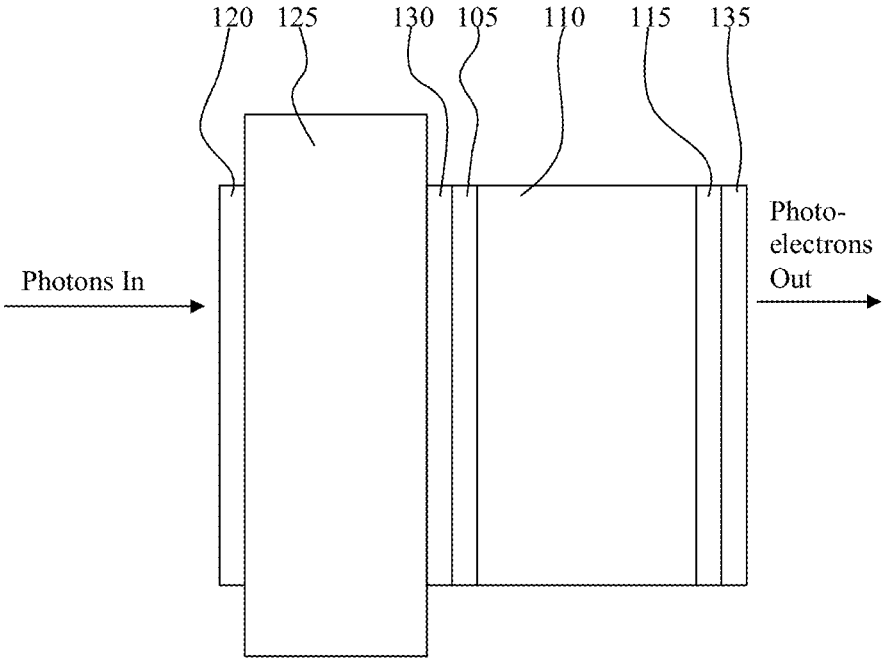
FIG. 2 shows a schematic depiction of an exemplary thermally assisted photocathode in a practical photocathode assembly.

Embodiments of the inventive thermally assisted negative electron affinity (TANEA) photocathode will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

FIG. 1A illustrates a schematic of a thermally assisted negative electron affinity (NEA) according to one embodiment. The device comprises an optical window layer 105, an optical absorber layer 110, and a thermionic emission layer 115. Table 1 further describes the active semiconductor layers of an embodiment of the thermally assisted negative electron affinity photocathode depicted schematically in FIG. 1A. The layers are listed in the order they are encountered by incoming light in a transmission mode structure.

TABLE 1

| Layer Number | Composition | Doping #/ $cm^3$ | Thickness Microns | Layer Title/ Function |
|---|---|---|---|---|
| 105 | $Al_{0.8}Ga_{0.2}As$ | P-type, $6 \times 10^{18}$ | 0.1 | Optical window layer |
| 110 | GaAs | P-type, $3 \times 10^{18}$ | 2 | Optical Absorber layer |
| 115 | $Al_{0.015}Ga_{0.985}As$ | P-type, $7 \times 10^{18}$ | .03 | Thermionic Emission Barrier Layer |

In order to conveniently make use of a thin semiconductor photocathode structure, it is useful to attach the cathode to a transparent support structure. A method to attach a semiconductor photocathode to a glass window is detailed in U.S. Pat. No. 3,769,536. Corning Code 7056 or a glass of similar expansion can be used via glass bonding as a support structure for GaAs photocathodes such as the one described in FIG. 1A and Table 1. On photocathodes intended for transmission mode use, photoresponse may be further improved through the use of anti-reflection coatings (ARCs). ARCs may be beneficially added both onto the exposed glass surface and between the glass to semiconductor interface. A $SiN_xO_y$ layer with an appropriate index of refraction and thickness can be used as an antireflection coating at the semiconductor—glass interface. A variety of coatings such as MgF may be used on the exposed glass surface.

Finally, the photocathode must be brought into an effective negative electron affinity (NEA) state. Although the surface of the semiconductor remains below the energy of the vacuum level, in this disclosure the conventional nomenclature is used of referring to a cathode as being in an effective state of negative electron affinity if the undepleted portion of the conduction band of the barrier layer lies above the energy of a free electron in vacuum. In order to achieve a surface conducive to efficient photoelectron emission, a photocathode may be chemically cleaned, then given a vacuum thermal cycle in order to desorb any residual surface contaminants and finally coated with work function reducing materials such as, but not limited to, $Rb+O_2$, $Cs+O_2$ or $Cs+NF_3$. Details on a potential GaAs photocathode vacuum thermal cleaning process are found in U.S. Pat. No. 4,708,677. Semiconductor photocathode processing with cesium and oxygen was first described in U.S. Pat. No. 3,644,770. A more modern discussion of GaAs photocathode manufacturing methods are further detailed in a book written by Illes P. Csorba titled "Image Tubes", copyright 1985, ISBN 0-672-22023-7. In the book, section 12.1.9.6 details "The Generation 3 Photocathode" Generation 3 image intensifiers use GaAs photocathodes similar to the prior art photocathode of FIG. 1B. The methods taught by Csorba are directly transferable to the structure disclosed in FIG. 1A. Csorba provides details on all of the major photocathode manufacturing steps from cathode growth through the deposition of a work-function lowering $Cs+O_2$ coating; to the extent that new materials are added in layer 115, one skilled in the art may fine tune the described processes, if required, in order to achieve the desired results. GaAs photocathode activation physics is described in detail by: Applied Physics A: Materials Science & Processing (Historical Archive) Negative affinity 3-5 photocathodes: Their physics and technology by W. E. Spicer, Issue: Volume 12, Number 2, Date: Feb. 1977 Pages: 115-130.

FIG. 1A shows a schematic depiction of the active semiconductor layers which constitute a basic embodiment of the thermally assisted negative electron affinity (TANEA) photocathode. Light may enter either side of the photocathode. However, the structure is often employed as a transmission mode photocathode. In the case of transmission mode operation, light will enter the photocathode through layer 105. Layer 105 is a p-doped semiconductor layer where the bandgap of the semiconductor is larger than that of the p-doped semiconductor layer designated 110. The doping and thickness of layer 105 are chosen such that several criteria are met. First, the thickness and the doping of layer 105 are chosen such that any transferred charge or interface states present on the surfaces of layer 105 are compensated by the p-type dopant without fully depleting the layer. Secondly, the dopant level and thickness of layer 105 is chosen such that the un-depleted thickness of the layer is sufficient to prevent meaningful tunneling of charge to or from the conduction band of semiconductor layer 110. As detailed in Table 1, an $Al_{0.8}Ga_{0.2}As$ layer p-doped to 6E18 $cm^{-3}$ at a thickness of 0.1 microns, meets these criteria. Layer 105 is often referred to as a window layer in that for a transmission mode application of the photocathode, light that has an energy falling below the bandgap energy of layer 105 may enter the photocathode with minimal absorption similar to light passing through an optical window. A semiconductor heterojunction is formed at the interface of layers 105 and 110. Materials 105 and 110 are chosen such that the heterojunction provides a low interface recombination velocity for electrons residing in the conduction band of layer 110. Layer 110 is a p-type semiconductor layer. The absorption coefficient and thickness of layer 110 typically determine the spectral response of the photocathode. Incident light transmitted through layer 105 is absorbed in layer 110. Layer 110 is often referred to as an absorber layer.

In the embodiment of FIG. 1A, photoelectrons generated via the absorption of light in layer 110 are subsequently transported to the interface between layer 110 and 115. The thickness and doping of layer 110 are typically chosen as a compromise between a number of factors. Those factors include the absorption coefficient for the wavelength range of interest, the temperature range of interest, the photoelectron (minority carrier) diffusion length and the energy difference between the Fermi level and the conduction band. The values quoted in Table 1 for layer 110 are reasonable choices for a room temperature photocathode designed to image at night under natural starlight conditions. Layer 115 is designed so as to result in a conduction band barrier when compared to layer 110. This barrier may be introduced via an increase in the bandgap of layer 115 relative to layer 110 forming a heterojunction or by an increase in the p-type doping concentration of layer 115 relative to layer 110 or by a combination of these two methods. The heterojunction may be formed by a distinct atomically sharp transition or via a short ramp in the atomic constituents of the layer. Any ramp, if present, should be much shorter than the characteristic minority carrier diffusion length of the photoelectrons. Layer 115 may be referred to as a barrier layer due to the fact that the increase in the conduction band energy relative to layer 110 will generally decrease the efficiency of photoelectron transport toward the photoemission surface. In this embodiment, layer 115 also plays the role of the photoemission surface. In the example structure detailed in Table 1, layer 115 is described as p-type $Al_{0.015}Ga_{0.985}As$; it should be noted that alternate compositions within the family of compounds encompassed by p-type $Al_XGa_{(1-X)}As_YP_{(1-Y)}$ including the case where X=0 would fully meet the defined criteria for this layer.

From a manufacturing control point of view the material $Al_XGa_{(1-X)}As$ a subset of the material family $Al_XGa_{(1-X)}As_YP_{(1-Y)}$ has been shown to be easily controllable and therefore is favored as a practical embodiment for layer 115. $Al_XGa_{(1-X)}As$ compositions where X is less than ~0.1% show little practical benefit over GaAs. For the particular material and growth parameters tested for room temperature cathodes $Al_XGa_{(1-X)}As$ compositions with X values greater than ~0.04 resulted in excessive photoelectron transport losses. Consequently, initial prototype photocathodes targeted X values ranging from ~0.001 to 0.04. Promising results for room temperature optimized photocathodes were grouped in the approximate range of X=0.01 to X=0.03. A photocathode using an $Al_XGa_{(1-X)}As$ barrier layer (115) X value of approximately 0.015 significantly outperformed a standard GaAs NEA photocathode.

In order to be readily incorporated into a useful device such as an image intensifier as disclosed by U.S. Pat. No. 6,437,491, EBAPS as disclosed in U.S. Pat. No. 6,285,018, EBCCD as disclosed in U.S. Pat. No. 4,687,922, or PMT as disclosed in U.S. Pat. No. 9,425,030, the photocathode may be bonded to a support window. FIG. 2 schematically depicts the photocathode described in Table 1 after it has been anti-reflection coated and bonded to a transparent support substrate or window. In FIG. 2, the assembly is depicted as a transmission mode photocathode. The decision to employ this embodiment in a transmission mode photocathode is not meant as a limit on this disclosure, but rather just as one example. The disclosed structures will also yield performance benefits for reflection mode photocathodes.

Light enters from the left side of FIG. 2. The first layer encountered by the light is an anti-reflection coating designated as 120. Layer 120 may be a simple MgF ¼-wave coating at the wavelength of interest or it may be a multilayer coating designed for a specific set of targeted wavelengths or wavelength band. Alternatively, this layer may be omitted without impacting the intent of this disclosure. The second layer encountered by the incoming light is the transparent support substrate depicted as layer 125. Layer 125 may be fabricated from Corning code 7056 glass or another transparent material. Corning code 7056 glass has been demonstrated to be a suitable support substrate for glass bonded GaAs based photocathodes. The next layer encountered by the incoming light is layer 130. Layer 130 is an anti-reflection coating designed to minimize light loss as the incoming light transitions from layer 125 and enters the photocathode structure. Layer 130 may be formed from $SiO_xN_y$ a material composed of silicon oxygen and nitrogen at a composition and thickness designed to achieve a minimum total reflection loss over the desired operational wavelength band of the photocathode. Upon leaving layer 130, the light enters the photocathode structure described in Table 1. The first layer of the photocathode is layer 105, the window layer. The window layer is designed to have a larger bandgap than the optical absorber layer 110, both to allow light to pass easily through the window layer and to specify a low loss electron recombination velocity interface with the optical absorber layer. The light in the wavelength band of interest is primarily absorbed in layer 110 the optical absorber layer. Absorption of the light in layer 110 results in the generation of electron hole pairs where the electrons thermalize to the conduction band minimum reside of layer 110. Diffusion transports the photoelectrons in the conduction band to the barrier layer (115) interface where the most energetic of the electrons in the thermalized electron energy distribution have a higher probability of diffusing across to the activation layer 135. As the energetic electrons approach the interface between layer 115 and 135, they will encounter an electric field that will tend to accelerate the electrons toward the vacuum lying beyond the surface of layer 135. A significant fraction of the energetic electrons entering the activation layer will subsequently be emitted from the surface of the photocathode assembly. Layer 135 may be composed of Cesium and Oxygen. Methods of forming an efficient activation layer are well known to those skilled in the art. The exact composition of the activation layer is not material to the teaching of this disclosure.

Figure 3:
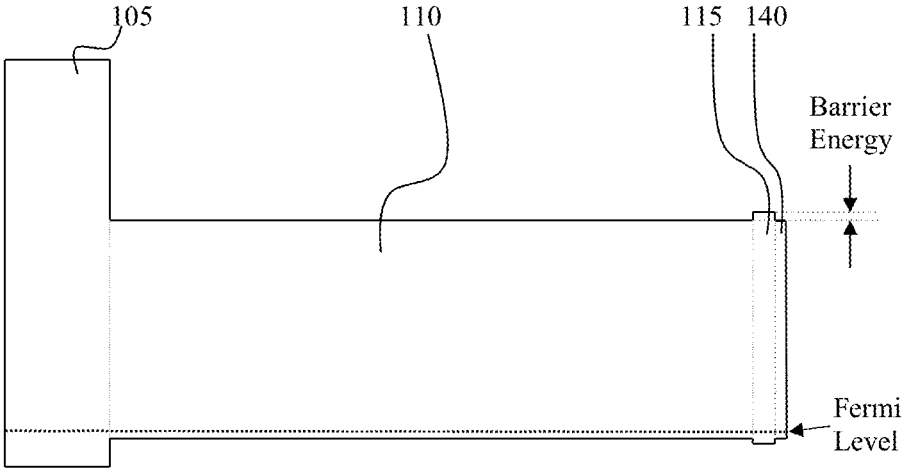
FIG. 3 shows an alternate embodiment of the thermally assisted photocathode including a thin emitter layer to specify the surface chemistry of the photocathode.

An alternate embodiment of the TANEA photocathode is shown schematically in FIG. 3 and detailed in Table 2. FIG. 3 is a schematic bandgap diagram of Thermally Assisted Negative Electron Affinity Photocathode containing an additional layer to modify photocathode surface chemistry.

TABLE 2

| Layer Number | Composition | Doping #/ $cm^3$ | Thickness Microns | Layer Title/ Function |
|---|---|---|---|---|
| 105 | $Al_{0.8}Ga_{0.2}As$ | P-type, $6 \times 10^{18}$ | 0.1 | Optical window layer |
| 110 | GaAs | P-type, $3 \times 10^{18}$ | 2 | Optical Absorber layer |
| 115 | $Al_{0.015}Ga_{0.985}As$ | P-type, $7 \times 10^{18}$ | .03 | Thermionic Emission Barrier |
| 140 | GaAs | P-type, $7 \times 10^{18}$ | .005 | Surface Specification Layer |

The alternate embodiment depicted in FIG. 3 interposed an additional emitter or emission layer between the thermionic barrier layer and the vacuum surface. The primary purpose of this layer is to specify a surface chemistry on the vacuum surface of the photocathode which is conducive to the formation of a stable, high efficiency activation layer. As detailed in Tables 1 and 2, the photocathodes will exhibit a relatively high work function. In order to produce a surface that exhibits a high photoelectron escape probability, the semiconductor surface must first be cleaned to remove surface contaminants including native oxides. Numerous methods have been detailed in the literature to achieve an atomically clean surface including wet cleaning with HCl solutions to remove bulk surface oxides, heat cleaning to desorb residual oxides, adsorbed contaminants and atomic hydrogen cleaning. Some oxides and surface contaminants are more difficult to remove than others. Aluminum oxide is a particularly difficult oxide to remove. The presence of aluminum oxide may interfere with the ability to form a high efficiency photocathode. As detailed in Table 2, a thin GaAs layer 140 may be formed over the barrier layer in order to eliminate the presence of native aluminum oxide on the surface of the photocathode. Experiments have demonstrated that the use of thin GaAs surface layers does not negate the benefit of the thermionic emission barrier layer. Both doped as shown in Table 2 and intrinsic (non-intentionally doped) GaAs surface layers have been tested at thicknesses up to 10 nm with good results. Based on this data we project that the GaAs surface layer may be beneficial to incorporate in a thickness range between that of a single atomic layer up to a thickness of in excess of 30 nm. After cleaning the surface is activated using a work-function lowering coating such as Cs—O.

Whereas initial examples of embodiments focus on the commercially important GaAs photocathode family, this invention is not limited to this material system. Based on the increased trade space available to the photocathode engineer with the application of thermionic barriers, significant improvements in longer wavelength photocathodes should be possible. An alternate embodiment of a thermally assisted negative affinity photocathode, for use at room temperature, consistent with this disclosure and the FIG. 1A sketch is detailed in Table 3 below. Layer 115 is described in the table with two different potential compositions. The choice is left to the photocathode engineer to determine the relative merits of ease of growth, surface chemical stability or cleaning concerns and issues like the maintenance of lattice constant; once again, these alternate embodiments are envisioned and claimed by this disclosure. In fact, any of the III-V semiconductor family of compounds may be used to design applicable TANEA photocathodes Group 5 elements that are specifically envisioned as being applicable include Aluminum, Gallium and Indium. Group 3 elements envisioned as suitable photocathode constituents include Nitrogen, Phosphorus, Arsenic and Antimony.

TABLE 3

| Layer Number | Composition | Doping #/ $cm^3$ | Thickness Microns | Layer Title/ Function |
|---|---|---|---|---|
| 105 | $Al_{0.8}Ga_{0.185}In_{0.015}As$ | P-type, $6 \times 10^{18}$ | 0.1 | Optical Window Layer |
| 110 | $Ga_{0.985}\ In_{0.015}As$ | P-type, $3 \times 10^{18}$ | 2 | Optical Absorber Layer |
| 115 | GaAs or $Al_{0.015}Ga_{0.97}In_{0.015}As$ | P-type, $7 \times 10^{18}$ | .03 | Thermionic Emission Barrier Layer |

Figure 4A:
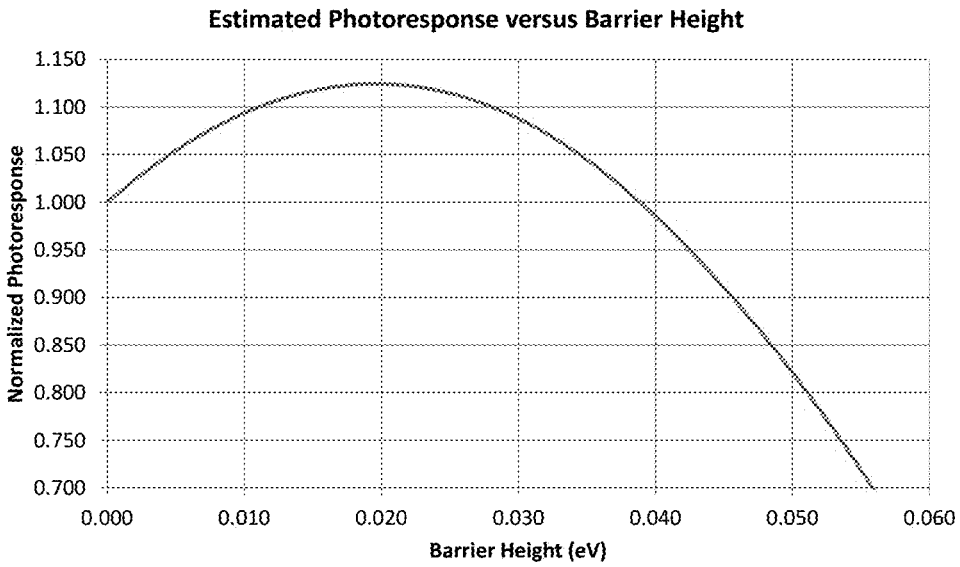
FIG. 4A shows an estimated photoresponse versus estimated conduction band barrier height in eV curve.
Figure 4B:
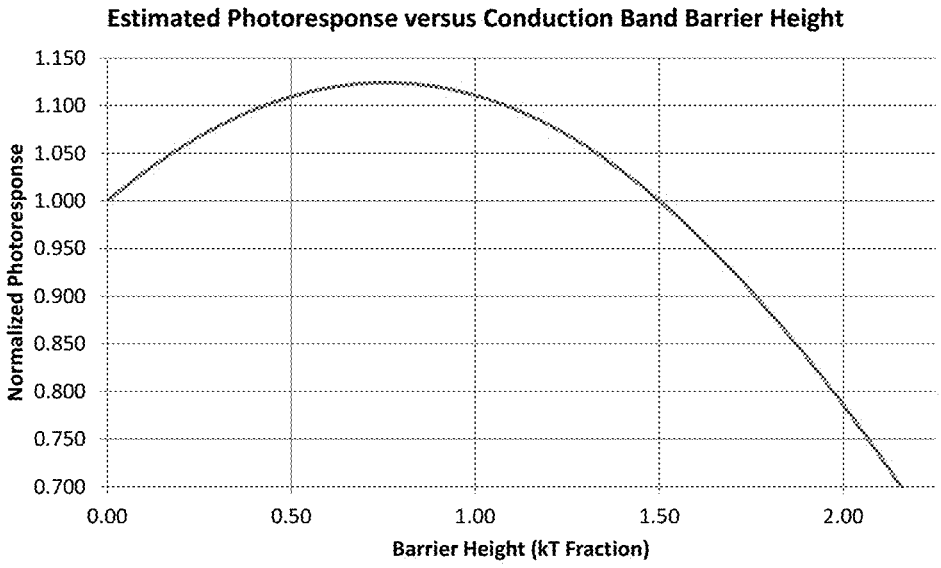
FIG. 4B depicts the photoresponse as a function of estimated barrier height reported as a fraction of kT where T, the temperature is set to 295 Kelvin and k is the Boltzmann constant.

Although the change in bandgap of the barrier layer is relatively small for the thermionic barrier layer detailed in Tables 1 and 2, the effects of incorporating the barrier in the detailed structures results in a meaningful, repeatable improvement in the room temperature (~293K) photocathode sensitivity versus the standard prior art photocathode. Based on measured and extrapolated experimental data the estimated improvement in photoresponse of a TANEA cathode versus the response of a prior art (FIG. 1B) GaAs photocathode was plotted as a function of conduction band barrier height. This estimate is plotted in FIG. 4A. The data is replotted in FIG. 4B where the barrier height is now normalized as a fraction of kT where k is the Boltzmann Constant and T is the Kelvin temperature at which the measurements were made (~295K). Although no new information is incorporated in FIG. 4B, it illustrates how a photocathode engineer may approach optimizing a TANEA photocathode for operation over a specific temperature range. The response versus barrier height curve will be different for each material system based on a wide range of material quality and interface properties. Nonetheless, the data generated on this material system demonstrates that the trade-offs inherent in the TANEA photocathode can result in a significant advantage over prior art photocathodes and by virtue of example suggests that empirical testing for new material systems may be fruitful in the 0 to 1.5 kT barrier height range for the temperature range of interest. Similarly, it should be noted that it is likely that the greatest advantage of the TANEA photocathode over prior art photocathodes is likely to lie near the long wavelength limit of prior art NEA photocathodes (~1 eV bandgap). At these wavelengths, the escape probability versus bandgap relationship is quite pronounced on a logarithmic scale. Consequently, it is likely that the escape probability advantage afforded via the incorporation of a thermionic barrier near the surface of the photocathode will outweigh the electron transport cost for a range of barrier heights.

Figure 5:
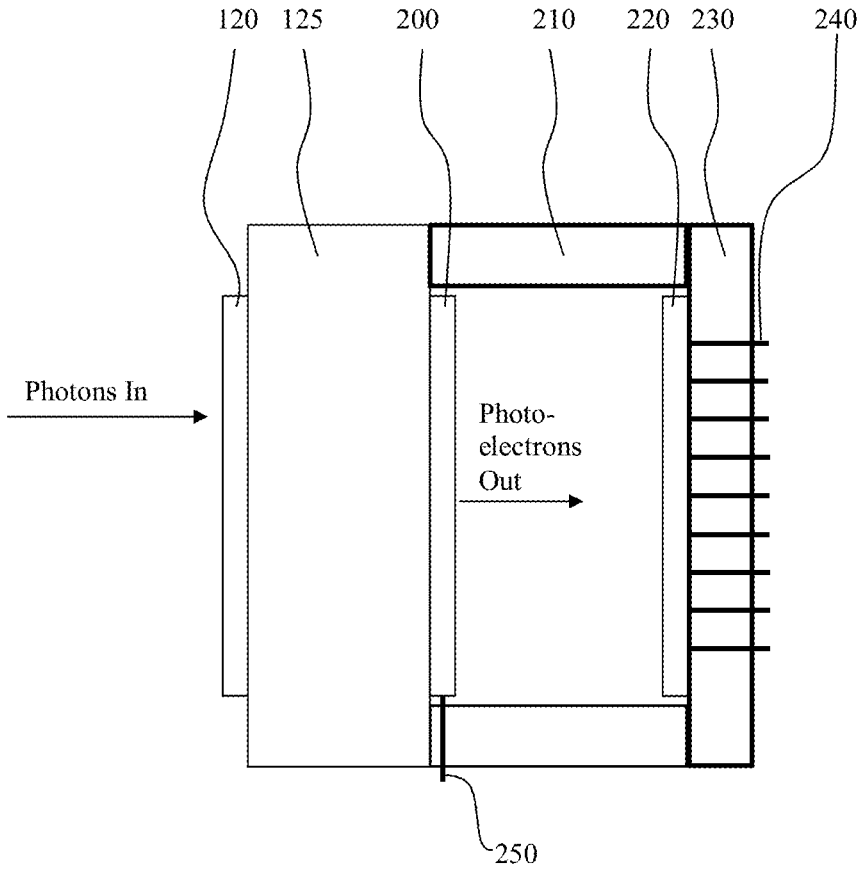
FIG. 5 shows an imaging sensor incorporating a TANEA photocathode. The electron imager accepting the photoelectron flux may comprise an electron bombarded active pixel sensor (EBAPS™) and EBCCD or other form of electron imager.

FIG. 5 is a schematic depiction of a vacuum image sensor incorporating a TANEA photocathode and an electron sensitive imager, such as an electron sensitive CMOS image sensor or an electron sensitive CCD. Layer 120 on the optical input surface is an anti-reflection coating as previously described in regards to FIG. 2. Similarly, 125 represents a transparent window (or substrate) as described in the FIG. 2 detailed description. In this case, the transparent window is used to form a portion of the vacuum envelope required to preserve a high level of sensitivity from the TANEA photocathode. The activation layer of the photocathode is particularly sensitive to contamination from oxygen, water and a wide variety of other trace gasses. In order to maintain clarity in FIGS. 5 and 6, the volume depicted by 200 represents the sum of the layers previously described in FIG. 2 as the balance of the TANEA photocathode assembly. Specifically, layers 130, 105, 110, 115 and 135 respectively as described in FIG. 2 are included and schematically represented as 200. This description is not meant to restrict the choice of the photocathode engineer, an equally acceptable embodiment may include layers 140 as described in FIG. 3 between previously described layers 115 and 135. Reference 210 represents that portion of the vacuum sensor body that makes up the side-walls of the sensor. Vacuum seals are formed on opposing surfaces of 210 in order to maintain a continuous unbroken vacuum envelope around the vacuum emission surface of the TANEA photocathode and the subsequent path of the emitted photoelectrons. 210 may be composed of a ceramic material such as $Al_2O_3$. 250 schematically represents an electrical connection from the outside of the vacuum envelope to the TANEA photocathode. The path of 250 is inconsequential to the intent of this disclosure as long as vacuum integrity is not compromised. An Ohmic contact between 250 and the semiconductor material of the TANEA photocathode is preferred. Simply overlaying a portion of the exposed TANEA photocathode semiconductor material with a metal layer such as Chromium is typically sufficient to generate an acceptable electrical connection to the photocathode. Generation of higher quality Ohmic contacts via the deposition and anneal of more sophisticated metallization schemes or other processes may be incorporated without impacting the intent of this disclosure. Reference 230 represents the vacuum enclosure completing the vacuum envelope opposite to the photocathode. This surface may be fabricated from a multi-layer ceramic block incorporating multiple electrical feedthroughs 240. 230 additionally may be used to physically mount an electron imaging sensor 220 within the electron flux emitted from the TANEA photocathode assembly 200. The electron sensitive image sensor 220 may constitute an electron bombarded active pixel sensor as detailed in U.S. Pat. No. 6,285,018. Similarly, 220 may be an electron bombarded CCD. It should also be noted that although the vacuum envelope side wall assembly 210 and the anode support surface of the vacuum enclosure 230 are depicted as separate objects, as detailed in U.S. Pat. No. 7,325,715, the side walls and anode support surfaces may be manufactured from a unitary ceramic assembly which includes all required electrical feedthroughs.

Figure 6:
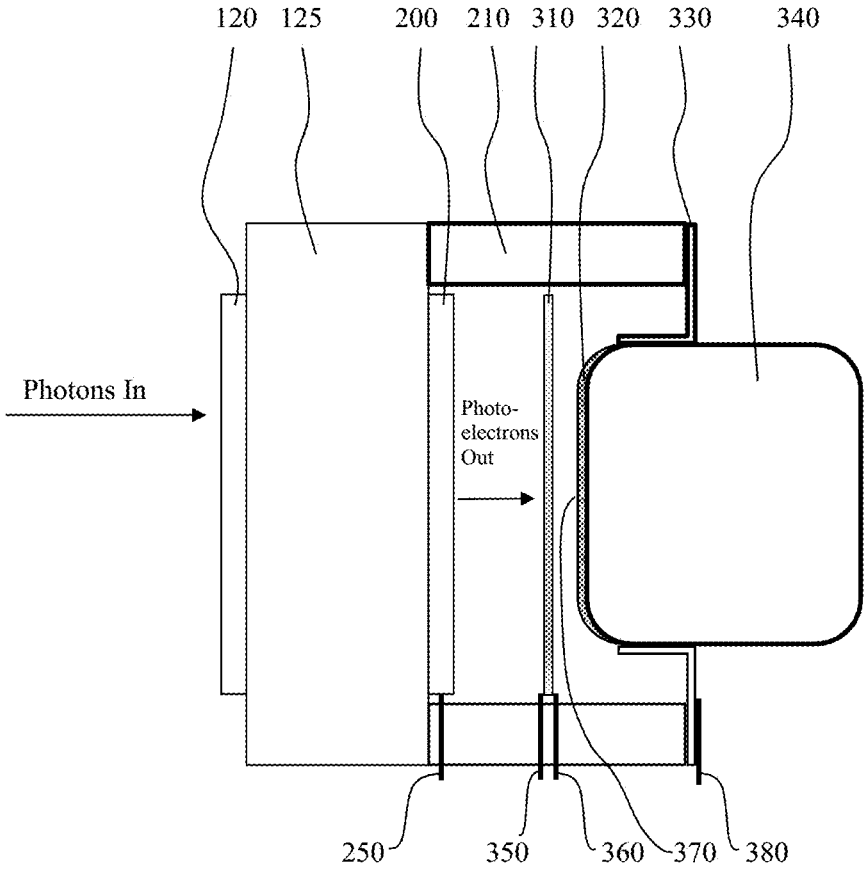
FIG. 6 shows a schematic representation of an image intensifier or a photomultiplier tube incorporating a TANEA photocathode. Note, independent of the image generated on the phosphor screen, the amplified electrical signal present on connection 370 meets the definition of a photomultiplier tube.

FIG. 6 depicts a vacuum tube incorporating a TANEA photocathode that may be used either as a photomultiplier tube or as an image intensifier. The configuration of sensor schematically shown in FIG. 6 is commonly referred to as a proximity focused image intensifier. Proximity focused image intensifiers typically maintain image fidelity (as quantified by sensor modulation transfer function or MTF) by fabricating the sensor using the minimal practical vacuum gaps between the parallel planes of the photocathode, the MCP and the phosphor screen. Minimizing vacuum gaps results in increased acceleration field strength for emitted electrons which in turn minimizes electron time of flight. The practical limit to vacuum gap is typically set by manufacturing yield issues associated with increased electron emissions from the negatively biased surfaces when the sensor is not illuminated, primarily in the form of point source electron emissions.

In FIG. 6 layer 120 on the optical input surface is an anti-reflection as previously described in regards to FIG. 2. Similarly, 125 represents a transparent window as described in the FIG. 2 detailed description. In this case, the transparent window is used to form a portion of the vacuum envelope required to preserve a high level of sensitivity from the TANEA photocathode. The activation layer of the photocathode is particularly sensitive to contamination from oxygen, water and a wide variety of other trace gasses. In order to maintain clarity in FIGS. 5 and 6, the volume depicted by 200 represents the sum of the layers previously described in FIG. 2 as the balance of the TANEA photocathode assembly. Specifically, layers 130, 105, 110, 115 and 135 respectively as described in FIG. 2 are included and schematically represented as 200. This description is not meant to restrict the choice of the photocathode engineer, an equally acceptable embodiment may include layer 140 as described in FIG. 3 between previously described layers 115 and 135. Reference 210 represents that portion of the vacuum sensor body that makes up the side-walls of the sensor. Vacuum seals are formed on opposing surfaces of 210 in order to maintain a continuous unbroken vacuum envelope around the vacuum emission surface of the TANEA photocathode and the subsequent path of the emitted photoelectrons. Side-wall 210 may be composed of a ceramic material such as $Al_2O_3$. Conductor 250 schematically represents an electrical connection from the outside of the vacuum envelope to the TANEA photocathode. A microchannel plate electron multiplier 310 is positioned inside the vacuum enclosure, facing the TANEA 200. An electrical bias voltage is applied between the front and back surfaces of the microchannel plate (MCP) via contacts 350 and 360 respectively. Contacts 350 and 360 also schematically represent the physical support structure for the MCP. When biased with an appropriate power supply, the MCP 310 will accept low level electron fluxes from the TANEA photocathode and multiply them by on the order of 1000× while retaining the positional information associated with the incoming electron flux. Electron multiplication may be performed using a single MCP or a stack of MCP if higher gain values are required. The multiplied electron flux is then accelerated across a second vacuum gap defined by the output of the final MCP and surface 370. Surface 370 is typically formed via a thin (~50 nm thick) Aluminum layer. Alternate conductive materials may be used to form surface 370 particularly when the tube is designed to be used as a photomultiplier tube. In the case where the sensor will be used as an image intensifier, a thin layer of Aluminum is beneficial due to the relatively high transmission of thin Aluminum to electrons accelerated to a few kV. Electrons that successfully transit the layer 370 encounter phosphor layer 320. When bombarded with electrons, phosphor layer 320 will generate an image that reproduces the photon image originally presented to the layer 200 TANEA photocathode assembly. The image is transmitted out through output window 340. Output window 340 may beneficially be made of any transparent material. In practice, Output window 340 may be composed of a fused fiber-optic bundle. Output window 340 and associated mounting flange 330 constitute a portion of the vacuum envelope of the vacuum tube. Mounting flange 330 is typically a conductive metal flange which serves to electrically connect the conductive surface 370 to external contact 380. Functionally, the sensor is biased by connecting various high voltage power supplies on contacts 250, 350, 360 and 380. All transits of contacts through the vacuum envelope are generated in a leak-tight manner to ensure the vacuum integrity of the sensor.

The present invention has been described in relation to particular examples, which are intended in all respects to be illustrative rather than restrictive. Those skilled in the art will appreciate that many different combinations will be suitable for practicing the present invention.

The invention claimed is:

1. A passive, single electrical potential p-type semiconductor photocathode, comprising:

an optical window;

an optical absorber abutting the optical window;

a thermionic barrier layer abutting the optical absorber;

wherein the thermionic barrier layer has a conduction band barrier comprising a barrier in conduction band energy sufficient in barrier height and barrier thickness so that transmission of photoelectrons across the barrier in conduction band energy is dominated by thermally excited electrons with sufficient energy to exceed the barrier height as opposed to tunneling through the barrier in conduction band energy.

2. A photocathode in accordance with claim 1, wherein the optical absorber is comprised of GaAs.

3. A photocathode in accordance with claim 2, wherein the thermionic barrier layer is comprised of AlGaAs.

4. A photocathode in accordance with claim 3 where the thermionic barrier layer AlGaAs contains an Al/(Al+Ga) atomic percentage of between 0.1% and 4% Al.

5. A photocathode in accordance with claim 4 where the thermionic barrier layer AlGaAs contains an Al/(Al+Ga) atomic percentage of approximately 1.5% Al.

6. A photocathode in accordance with claim 1, further comprising a surface chemistry specification layer abutting the thermionic barrier layer.

7. A photocathode in accordance with claim 6, where the surface chemistry specification layer is comprised of GaAs.

8. A photocathode in accordance with claim 7 where the thermionic barrier layer is comprised of AlGaAs.

9. A photocathode in accordance with claim 8 where the thermionic barrier layer AlGaAs contains an Al/(Al+Ga) atomic percentage of between 0.1% and 4% Al.

10. A photocathode in accordance with claim 9 where the thermionic barrier layer AlGaAs contains an Al/(Al+Ga) atomic percentage of approximately 1.5% Al.

11. A photocathode in accordance with claim 6, where the surface chemistry specification layer comprises an emission surface facing vacuum.

12. A photocathode in accordance with claim 6 where the surface chemistry specification layer thickness lies in the range of from one atomic layer to 30 nm.

13. A photocathode in accordance with claim 12 where the surface chemistry specification layer is comprised of GaAs.

14. A low-light sensor, comprising:

a vacuum enclosure;

a passive, single electrical potential p-type semiconductor photocathode positioned within the vacuum enclosure;

an electron receiving surface within the vacuum enclosure and facing the photocathode;

wherein the photocathode comprises:

an optical window;

an optical absorber abutting the optical window; and a thermionic barrier layer abutting the optical absorber;

wherein the thermionic barrier layer has a conduction band barrier comprising a barrier in conduction band energy sufficient in barrier height and barrier thickness so that transmission of photoelectrons across the barrier in conduction band energy is dominated by thermally excited electrons with sufficient energy to exceed the barrier height as opposed to tunneling through the barrier in conduction band energy.

15. The low light sensor of claim 14, wherein the electron receiving surface comprises an electron sensitive CMOS image sensor.

16. The low light sensor of claim 14, wherein the electron receiving surface comprises an electron sensitive CCD image sensor.

17. The low light sensor of claim 14, wherein the electron receiving surface comprises a surface of a microchannel plate.

18. The low light sensor of claim 14, further comprising a microchannel plate electron receiving surface facing the photocathode with output of the microchannel plate facing a thin conductive layer overlaid on a phosphor layer on an output window.

19. The low light sensor of claim 14, further comprising a microchannel plate electron receiving surface facing the photocathode with output of one or more stacked microchannel plates facing a thin conductive layer.

* * * * *